US012729030B2

(12) United States Patent
Casper

(10) Patent No.: US 12,729,030 B2
(45) Date of Patent: Sep. 8, 2026

(54) PLASTIC CONTAINER WITH TENSION BAND GEOMETRY AT THE BASE REGION

(71) Applicant: KRONES AG, Neutraubling (DE)

(72) Inventor: Mario Casper, Berlin (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 18/232,735

(22) Filed: Aug. 10, 2023

(65) Prior Publication Data

US 2024/0051700 A1 Feb. 15, 2024

(30) Foreign Application Priority Data

Aug. 10, 2022 (DE) ..... 10 2022 120 143.0

(51) Int. Cl.
*B65D 1/02* (2006.01)

(52) U.S. Cl.
CPC ..... *B65D 1/0207* (2013.01); *B65D 1/0284* (2013.01)

(58) Field of Classification Search
CPC ..... B65D 1/0207; B65D 1/0284
USPC ..... 215/377
See application file for complete search history.

(56) References Cited

U.S. PATENT DOCUMENTS

| | | | | |
|---|---|---|---|---|
| 8,109,397 | B2 | 2/2012 | Deyerl et al. | B65D 1/02 |
| 9,623,999 | B2 | 4/2017 | Boukobza et al. | B65D 1/02 |
| 11,649,085 | B2 | 5/2023 | Huettner et al. | B65D 1/02 |
| 2006/0201900 | A1* | 9/2006 | de Francesco | B65D 11/04 215/377 |
| 2010/0086635 | A1* | 4/2010 | Vieillot | B29C 49/6436 425/528 |

(Continued)

FOREIGN PATENT DOCUMENTS

| | | | |
|---|---|---|---|
| DE | 102013110139 | 3/2015 | B65D 1/02 |
| DE | 102019119984 | 1/2021 | B65D 1/02 |
| EP | 2036820 | 3/2009 | B65D 1/02 |

(Continued)

OTHER PUBLICATIONS

/German Search Report issued in German Patent Appln. No. 10 2022 120 143.0, dated Apr. 25, 2023, with machine English translation, 8 pages.

(Continued)

*Primary Examiner* — Orlando E Aviles
*Assistant Examiner* — Niki M Eloshway
(74) *Attorney, Agent, or Firm* — HAYES SOLOWAY P.C.

(57) ABSTRACT

A one piece plastic container having a base region, a base body adjoining such base region in the longitudinal direction of the plastic container, and a mouth region adjoining such base body in the longitudinal direction and having a mouth, wherein the base region has at least three supporting feet, at least one groove with a groove base extending in the circumferential direction over a circumferential angle arranged between adjacent supporting feet, the groove base acts as a tension band. The groove base has a central tension band region in which the wall of the container is inwardly bulged and arranged in the circumferential direction between two lateral tension band regions. The groove base is in a cross-section perpendicular to the longitudinal direction in the central tension band region according to a first curvature property and designed in the two lateral tension band regions according to a second curvature property.

17 Claims, 7 Drawing Sheets

(56) References Cited

U.S. PATENT DOCUMENTS

| | | | | |
|---|---|---|---|---|
| 2017/0121049 | A1 | 5/2017 | Bouquin et al. | B65D 1/02 |
| 2020/0198827 | A1* | 6/2020 | Dabrowski | B65D 1/0284 |

FOREIGN PATENT DOCUMENTS

| | | | | |
|---|---|---|---|---|
| EP | 3538444 | | 9/2019 | B65D 1/02 |
| FR | 2967975 | A1 * | 6/2012 | B65D 1/0284 |
| FR | 3022223 | A1 * | 12/2015 | B65D 1/0207 |
| WO | WO-2011131893 | A1 * | 10/2011 | B65D 1/0284 |
| WO | WO-2017103467 | A1 * | 6/2017 | B65D 1/0284 |
| WO | WO-2018089908 | A1 * | 5/2018 | A47G 19/22 |
| WO | WO-2020202727 | A1 * | 10/2020 | B65D 1/0284 |
| WO | WO-2022103992 | A1 * | 5/2022 | B65D 1/0223 |

OTHER PUBLICATIONS

European Search Report issued in EP Patent Appln. No. 23189463.5, dated Dec. 8, 2023, with machine English translation, 12 pages.

* cited by examiner

PLASTIC CONTAINER WITH TENSION BAND GEOMETRY AT THE BASE REGION

BACKGROUND OF THE INVENTION

The present invention relates to a plastic container—preferably a PET plastic container—and/or to a plastic bottle. In particular, the present invention relates to a plastic container for beverages. In addition, the invention is also directed towards a base structure for such a plastic container. In the prior art, plastic containers are usually produced by blow molding processes and, in particular, stretch blow molding processes. For this purpose, heated plastic preforms in particular are expanded inside blow molds to form plastic containers or plastic bottles.

So-called petaloid bottle bases are known from the prior art. Containers with a petaloid bottle base have a plurality of supporting feet, and often five supporting feet. For example, the container bases bear the weight of the filled bottles and are therefore subject to relatively high loads. It is known from the prior art that grooves run between such supporting feet.

For the design of PET-petaloid bottle bases (free-form bases) in hot locales, a so-called tension band is used in the prior art, for which the use of a rotated surface as a tension band between the (supporting) feet is known from the prior art, which collects more material to keep the base center in position, similarly to a "safety belt," even under internal pressure and temperature effects.

In particular, a tension band arranged in the base region of a container—in particular, provided between the supporting feet—serves to transfer forces acting upon the base center point or the base center—such as an injection point of a plastic container—to a side wall of the plastic container via the tension band.

Wide tension bands mean that it becomes increasingly difficult to sufficiently shape the base and also to stretch the material into the feet tips. The result is dents and stress whitening in the feet tips.

It also happens that the PET material sometimes arrives at the mold too early, cools down, and is subsequently moved even further by the stretching process. This creates visible distortions ("chatter marks") that can lead to weakening of the tension band region.

From EP2036820 A1, a petaloid free-form base with a tension band having a constant radius of curvature is known.

DE 10 2013 110 139 A1 describes a plastic container with a petaloid base, in which, between two adjacent feet, a tension band is designed as a groove base, which is outwardly bulged and has a constant curvature when viewed in the circumferential direction. The base wall of the container is thus outwardly bulged—in particular, in the region of a groove base and in particular in the region of a geometric center of the groove base—comparable to a region of a spherical surface. It is also described that the tension band surface is created by a rotation about an axis of rotation.

From DE 10 2019 119 984 A1, a tension band cross-sectional contour that substantially completely follows an nth-degree spline is known.

SUMMARY OF THE INVENTION

The present invention is based upon the object of overcoming the disadvantages known from the prior art and providing a plastic container and a blow molding device for the production of such plastic containers, which offer the best possible distribution of the plastic material during the production of the plastic container (for example, in a stretch blow molding process, in which a plastic preform is pressed by means of fluid medium against a blow mold having a base shape), and at the same time a high base stability with the lowest possible material consumption is achieved, such that the dead weight along with any internal pressure that arises (as in the case of carbonated beverages) can be withstood.

A plastic container according to the invention—in particular, for beverage—has a base region, a base body adjoining such base region in the longitudinal direction of the plastic container, and a mouth region with a container mouth adjoining such base body at least indirectly in the longitudinal direction.

The base region has at least three supporting feet—preferably at least five and particularly preferably exactly five supporting feet. At least one groove with a groove base extending in the circumferential direction over a (predetermined) circumferential angle is arranged between two—in particular, adjacent—such supporting feet. Thereby, the groove base acts as a tension band. In particular, the groove base is designed over the (predetermined) circumferential angle (in particular, by its shape) in such a manner that it acts as a tension band or is suitable for acting as a tension band. Furthermore, the container is preferably designed in one piece.

According to the invention, the (in particular, each) groove base (or the tension band) has—in particular, in each case—a central tension band region (and, in particular, two lateral tension band regions), in which the wall of the container is inwardly bulged and which is arranged in the circumferential direction between two lateral tension band regions.

Preferably, the progression of the groove base in the one lateral tension band region is mirror-symmetrical to the progression of the groove base in the second lateral tension band region (in particular, the planes of symmetry extend through a geometric center of the groove base in the central tension band region). Preferably, the progression of the groove base in the central tension band region is mirror-symmetrical to a plane of symmetry that runs substantially through a geometric center of the groove base (in the central tension band region).

Preferably, the groove base is designed in a (preferably, substantially any) cross-section perpendicular to the longitudinal direction (i.e., in particular, within and preferably substantially within any cross-sectional plane extending perpendicular to the longitudinal direction (through the groove base)) in the central tension band region according to (at least) a first curvature property and, in the two lateral tension band regions, according to (at least) a second curvature property, which is different from the first curvature property. Preferably, the groove base in the (preferably, substantially any) cross-section perpendicular to the longitudinal direction in the lateral tension band regions is designed according to the same second curvature property.

In particular, in other words, "the groove base in a cross-section perpendicular to the longitudinal direction" means a contour running along the groove base, which runs within a cross-sectional plane extending perpendicular to the longitudinal direction.

Preferably, the groove base in the (preferably, substantially any) cross-section perpendicular to the longitudinal direction in the central tension band region follows a contour that is designed and/or constructible according to the first curvature property.

Preferably, the groove base in the (preferably, substantially any) cross-section perpendicular to the longitudinal direction in each of the two lateral tension band regions follows a contour that is designed and/or constructible according to the second curvature property.

In other words, the central tension band region, on the one hand, and the two lateral tension band regions, on the other, are constructed in different manners. In particular, the lateral tension band regions are not a (constructive and/or geometrical) continuation of the central tension band region, but, rather, the lateral tension band regions (in particular, one and preferably each cross-section perpendicular to the longitudinal direction) follow a contour (line) constructed by means of different construction parameters (compared to construction parameters of the central tension band region).

In particular, it is proposed that the tension band or the groove base (viewed in the circumferential direction) have, in contrast to the prior art, at least (and, preferably, exactly) three regions, the (first lateral tension band region, the central tension band region, and the second lateral tension band region), wherein two adjacent tension band regions are distinguishable from one another (in each case) in terms of their (geometric) construction and/or in terms of a curvature property.

In other words, the progression of the groove base (in the cross-section perpendicular to the longitudinal direction) in the central tension band region at least in sections, and preferably the entire progression of the groove base in the central tension band region, is characteristic of the first curvature property.

In other words, the progression of the groove base (in the cross-section perpendicular to the longitudinal direction) in the (preferably each) lateral tension band region at least in sections, and preferably the entire progression of the groove base in the lateral tension band region, is characteristic of the second curvature property.

The curvature property can be an amount of curvature, e.g., a range, within which the amount of curvature of a contour (within the cross-sectional plane perpendicular to the longitudinal direction) running along the groove base moves in the respective (central or lateral) tension band region.

Thereby, the orientation of the groove base in the central tension band region can be the same or opposite to the orientation of the groove base in the lateral tension band region or in the two lateral tension band regions (in the cross-sectional plane perpendicular to the longitudinal direction). It is also conceivable that the groove base (at least in sections or as a whole) not be curved in the lateral tension band region (at least in a cross-sectional plane perpendicular to the longitudinal direction) and/or the amount of curvature of the groove base in the lateral tension band region be zero (at least in sections or as a whole).

For example, the amount of curvature of the groove base (within a predetermined cross-sectional plane perpendicular to the longitudinal direction) in the center tension band region (each) can be selected from a first (predetermined) range, and the amount of curvature of the groove base (within the predetermined cross-sectional plane perpendicular to the longitudinal direction) in the (each of the two) lateral tension band regions can be selected from a second (predetermined) range, wherein the second range is different from the first range. Preferably, the second region and the first region have (substantially) no overlap. Preferably, an overlapping region of equal amounts of curvature of the first and second regions occupies less than 20%, preferably less than 10%, and particularly preferably less than 5%, of the first and/or second regions.

Additionally or alternatively (and/or in a preferred embodiment), the groove base in a cross-section perpendicular to the longitudinal direction (i.e., in particular, within a cross-sectional plane extending perpendicular to the longitudinal direction) in the central tension band region preferably has, at least in sections (and preferably in the entire central tension band region), a curvature with a greater amount of curvature than the groove base in the two lateral tension band regions. Thereby, the orientation of the curvature of the groove base in the lateral tension band region and preferably in the two lateral tension band regions can have the same orientation as the curvature or the bulge of the groove base in the central tension band region. Alternatively, the orientation of the curvature of the groove base in the lateral tension band region, and preferably in the two lateral tension band regions, can have an opposite orientation to the curvature or bulge of the groove base in the central tension band region. It is also conceivable that the groove base in the lateral tension band region and preferably in the lateral tension band regions be designed to be planar or flat and/or run in a rectilinear manner in cross-section or have no curvature.

In addition or alternatively, the curvature of the groove base in the central tension band region is preferably more pronounced, at least in sections, than a bulge of the groove base in the two lateral tension band regions (in particular, independently of the orientation of any bulge of the respective tension band region). Thereby, preferably (here as well), the orientation of the bulge of the groove base in the central tension band region can be the same or opposite to the orientation of the bulge of the groove base in the lateral tension band regions. It is also conceivable that the groove base not be bulged in the lateral tension band regions (at least in sections or in its entirety).

Preferably, the two lateral tension band regions have a curvature that is significantly different from the bulge of the center tension band region. Preferably, the groove base in the two lateral tension band regions has a curvature that is significantly different from the bulge of the groove base in the center tension band region.

In a preferred embodiment, (within and preferably substantially within each predetermined cross-sectional plane perpendicular to the longitudinal direction) an (in particular, respective and/or preferably each) ratio of an amount of curvature of the groove base in the central tension band region to an amount of curvature of the groove base in the lateral tension band region is (particularly, substantially) greater than 2, preferably greater than 2.5, preferably greater than 3, preferably greater than 5, preferably greater than 10, preferably greater than 15, preferably greater than 20, preferably greater than 25, and particularly preferably greater than 30. Here, "substantially" means in particular that this applies to all points of the groove base (within a predetermined cross-sectional plane perpendicular to the longitudinal direction) except for a transition region between the central tension band region and the lateral tension band region in each case. Thereby, the transition region preferably occupies no more than 50%, preferably no more than 40%, preferably no more than 30%, preferably no more than 20% and particularly preferably no more than 10%, of the contour length or arc length and/or a circumferential angle (over which the respective—in this case, central or lateral—tension band region extends) of the groove base in the central tension band region and/or in the respective lateral tension band region.

Preferably (within a predetermined cross-sectional plane perpendicular to the longitudinal direction), a ratio of the amount of curvature of the groove base at at least one point in the central tension band region and preferably at any point within a first (preferably contiguous) section in the central tension band region to the amount of curvature of the groove base at at least one point in the lateral tension band region and preferably at any point within a second (preferably contiguous) section in the lateral tension band region is greater than 2, preferably greater than 2.5, preferably greater than 3, preferably greater than 5, preferably greater than 10, preferably greater than 15, preferably greater than 20, preferably greater than 25, and particularly preferably greater than 30.

Preferably, the first section thereby extends over at least 10%, preferably at least 20%, preferably at least 25%, preferably at least 30%, preferably at least 45%, preferably at least 50%, preferably at least 70%, preferably at least 75%, preferably at least 80%, preferably at least 95%, and particularly preferably at least 98%, of the length of the groove base in the central tension band region within the predetermined cross-sectional plane perpendicular to the longitudinal direction.

Preferably, the second section thereby extends over at least 10%, preferably at least 20%, preferably at least 25%, preferably at least 30%, preferably at least 45%, preferably at least 50%, preferably at least 70%, preferably at least 75%, preferably at least 80%, preferably at least 95%, and particularly preferably at least 98%, of the length of the groove base in one (preferably each) of the lateral tension band regions within the predetermined cross-sectional plane perpendicular to the longitudinal direction.

For example, the amount of curvature of the groove base (within a predetermined cross-sectional plane perpendicular to the longitudinal direction) in the center tension band region (each) can be selected from a first (predetermined) range, and the amount of curvature of the groove base (within the predetermined cross-sectional plane perpendicular to the longitudinal direction) in the (each of the two) lateral tension band region(s) can be selected from a second (predetermined) range, wherein the second range is (at least partially and preferably completely) different from the first range and preferably has no common values for the amount of curvature.

In particular, therefore, the lateral tension band regions have a curvature that is significantly different from the bulge of the central tension band region.

Preferably, the wall of the container or the groove base is outwardly bulged in each of the two lateral tension band regions at least in some regions, and, preferably, substantially in the entire respective tension band region.

It is also conceivable that the wall of the container or the groove base be bulged inwards in each of the two lateral tension band regions at least in some regions, and, preferably, substantially in the entire respective tension band region.

It is also conceivable that the wall of the container or the groove base in each of the two lateral tension band regions be designed to be flat or planar and/or designed to be rectilinear in cross-section at least in some regions, and, preferably, substantially in the entire respective tension band region.

In a preferred embodiment, the wall of the container is outwardly bulged in each of the two lateral tension band regions, while, preferably in the central tension band region, the wall of the container is inwardly bulged. Preferably, the two lateral tension band regions each have mirror-symmetrically identical curvature properties.

Preferably, in the central tension band region, the wall of the container is always inwardly bulged and differs significantly in the amount of curvature from the lateral tension band regions. In particular, the two lateral tension band regions and the central tension band region (in the circumferential direction) arranged between the two lateral tension band regions are arranged between two (adjacent) supporting feet. The surface of the central tension band region is bulged in particular towards the container interior or bottle interior.

Preferably, the two lateral tension band regions each form an outer tension band region (viewed in the circumferential direction) and/or an outer groove base region. Preferably, the (in particular, each) groove base or the (in particular, each) tension band (viewed in and/or against the circumferential direction) is bounded by one of the two lateral tension band regions (towards an adjacent supporting foot).

The wall of the container in the base region is in particular inwardly bulged at least in sections in a central region (the central tension band region) of the groove base of a groove, and outwardly bulged in the two edge regions of the groove base adjacent to the central region of the groove base (in particular, the lateral tension band regions).

It is also conceivable that the wall of the container in the base region be inwardly bulged—in particular, at least in sections—in a central region (the central tension band region) of the groove base of a groove, and, in the two edge regions of the groove base adjacent to the central region of the groove base (in particular, the lateral tension band regions), be inwardly bulged to a significantly greater or lesser extent or run in a rectilinear manner in cross-section.

By "inwardly bulged," it is to be understood in particular that the wall of the container is bulged in the respective region towards the container interior (as, for example, towards the bottle interior). Accordingly, "outwardly bulged" is to be understood in particular as meaning that the wall of the container is bulged in the respective region towards the outside of the container.

Thereby, the "inward bulge" and/or the "outward bulge" refer in particular to a bulge along a main direction of the (upper) surface, which corresponds to the circumferential direction.

The present invention offers the advantage that the bulge towards the (bottle) interior causes the tension band to fit better into the base geometry. This allows the material to be positioned more easily and in a more targeted manner, and stretched into the feet or the supporting legs. This preferably avoids the formation of distortions and increases stability. Furthermore, the ability to be blown and formed is improved.

The longitudinal direction is in particular a direction along a central axis of the plastic container. The central axis of the plastic container extends in particular (centrally) through the (opening of the) container mouth (and also, in particular, centrally through a base region of the container—in particular, through an injection point). In the upright position of the container, the central axis extends in particular parallel to a vertical direction.

A circumferential direction is preferably understood as a direction of rotation about the central axis (selected as the axis of rotation) (or longitudinal direction) of the container. In the following, a radial direction (with respect to the longitudinal direction) is understood as a direction with respect to the longitudinal direction (or the central axis of the container) that is perpendicular to the longitudinal direction (or the central axis) and that, in particular, moves away (in a rectilinear manner and, in particular, in a direction perpendicular to the central axis) from the longitudinal direction (or the central axis).

The circumferential angle is preferably understood as an angle in the circumferential direction about the central axis according to a projection in a plane perpendicular to the central axis. In particular, the circumferential angle over which the groove base extends is measured (as an angle in the circumferential direction about the central axis) at the projection of the groove base in a plane perpendicular to the longitudinal axis.

Preferably, the base body serves to hold the substantial filling volume (of a beverage). The base body has a completely circumferential (side) wall in a circumferential direction. Thereby, the base body can have a substantially circular (preferably circular) cross-section (with predetermined major diameter, cross-section when cut in a plane perpendicular to the central axis). It is also possible, however, for the base body to have a substantially square or rectangular cross-section—in particular, with rounded corners.

In other words, the base region in the central tension band region has a concavely-curved or concavely-bulged container outer surface (where "concave" here means in particular that a straight section between any selectable points of such surface runs completely outside the container wall). Preferably, such concave curvature or concave bulge is present substantially along the entire line segment between the injection point and/or between a central region around the injection point and the boundary of the base region towards the base body.

In particular, the base region has (in each case) in the lateral tension band region a convexly-curved or convexly-bulged container outer surface (where "convex" here means in particular that a straight section between any selectable points of this surface runs completely inside the container wall, and in particular in the base region). Preferably, such convex curvature or convex bulge is present substantially along the entire line segment between the injection point and/or between a central region around the injection point and the boundary of the base region towards the base body.

Preferably, the transition region or the region of the transition and/or the wall of the transition (or that curve at which the base body merges into the base region of the container) of the base body into the base region of the container has, at least in sections and in particular completely (in particular, in the case of a formed line (also referred to hereafter in particular as a circumferential line) running (exclusively) in the circumferential direction on the container or the wall and/or in the case of a formed line on the container or the wall, which has at least one direction of extension in the circumferential direction of the container), an outwardly-curved wall (from the container interior, approximately in the radial direction from the central axis of the container as viewed in a viewing direction to the outside). Preferably, such transition (region) does not have a groove (in particular, extending in the longitudinal direction) or an inwardly-curved region (in particular, when viewed along a line formed along the wall of the transition (region) and running in the circumferential direction).

Preferably, a tangent line at a point of a formed line formed on the outer wall (and/or inner wall) of the container along the longitudinal direction—in particular, at each point of the region where the base region merges into the base body—has exclusively a directional component in the longitudinal direction. Preferably, the transition region follows a progression corresponding to the lateral surface of a cylinder.

Thereby, a groove can be understood as a geometric structure that extends inwardly (in particular, for example, in the direction of the container mouth and/or the central axis) with respect to the (outer) wall of the container (surrounding it), i.e., for example, the (outer) wall of the base region—in particular, with respect to a normal level of the circumferential wall.

A groove base can be understood as a (partial) region of a groove that differs from at least one further region and in particular from the remaining region of the groove and/or from a foot flank surface of a supporting foot due to its (uniform or common) geometric construction, such as uniform parameters of a surface parameterization and/or selection of a surface (or a common rule for the surface construction).

The groove base can be understood as, for example, the (in particular, contiguous) region of a groove that substantially forms the (minimum) region extending (furthest) inwardly (and the region surrounding this). Thereby, the groove base preferably differs from the remaining region of the groove in that it has been designed according to a different surface shape compared with the remaining region of the groove and, in particular, with a region of the groove arranged laterally adjacent to the groove base, which is located between the groove base and the supporting foot. Preferably, the above-described region adjacent to the groove base and located between the groove base and the supporting foot is (in its entirety) part of a foot flank surface of a supporting foot (and, in particular, constructed accordingly as such).

Preferably, the groove base and/or the central tension band region and/or the two lateral tension band regions extends/extend radially outwardly (following the progression of the base wall in the longitudinal direction) from the injection point or a central region surrounding it, substantially up to (or almost up to) the base body. Preferably, the groove and/or the groove base and/or the central tension band region and/or the two lateral tension band regions extends/extend over at least 75%, preferably at least 80%, and particularly preferably at least 90%, of the arc length of a line starting from the injection point and/or the central region and formed from there on the base wall in the radial direction outwardly to the base body.

Preferably, the groove and/or its groove base (and, in particular, at least one arranged groove and/or its groove base extends between each of two supporting feet) extends in the radial direction (at least with one component). Preferably, the main direction of extension of the groove and/or the groove base in a projection of the groove or the groove base on a plane perpendicular to the longitudinal axis runs substantially and in particular exactly along a radial direction.

Preferably, at least one and preferably exactly one groove (with a groove base extending in the circumferential direction over a (predetermined) circumferential angle) is arranged between each two supporting feet arranged to be adjacent (laterally or in the circumferential direction), wherein, preferably, the respective groove has a main direction of extension running in the radial direction (wherein, in particular at least one component of the main direction of extension in each case points in a radial direction).

Preferably, a (each) groove base (and/or each groove) extends substantially along each base height section of the groove base, (wherein a base height of a section in the longitudinal direction is measured with a supporting plane on which the container stands as a reference plane)—in particular, substantially—over the same (predetermined) circumferential angle. This means that a region of the groove base closer to the supporting surface extends over substantially the same (predetermined) circumferential angle as a region of the groove base closer (viewed in the longitudinal direction) to the base body and/or the mouth region.

In other words, a projection of the groove base and/or a projection of the central tension band region and/or a projection of the (in particular, respective) lateral tension band region (against the longitudinal direction) onto a supporting plane of the container (which is arranged perpendicular to the longitudinal direction) occupies a segment of the respective projection surface (of the base region) that can be defined and/or described substantially by a circumferential angle.

Preferably, a groove base (in each case) is arranged substantially and, preferably, exactly symmetrically (with respect to the circumferential direction) between two (adjacent) supporting feet. Preferably, (each) groove and/or groove base is designed to be (axially) symmetrical with respect to a plane that extends in the longitudinal direction of the central axis or longitudinal direction of the container, and in a (radial) direction along the geometric center (viewed in the circumferential direction) of the groove and/or groove base.

Preferably, in the geometric center of a groove and, in particular, in the geometric center of a groove base, there is a wall region of the base region, which, with respect to wall sections in the circumferential direction, extends furthest (in the radial direction and/or towards the central axis) into the interior of the container. In other words, in the case of a line formed (exclusively) along the circumferential direction and running along the base wall (in particular, along the outer surface of the base region), the line section at the geometric center of a groove base is located closest to the central axis. Preferably, this line running (exclusively) along the circumferential direction has an inward bulge in the region of the groove base at least in sections, and preferably in the entire region of the groove base. If a section of the base region is formed with a plane perpendicular to the central axis, the plane is bulged inwards (towards the central axis) in the region of the groove base (in particular, in such entire region). Preferably, a turning region in which such bulge or curvature reverses and/or changes its orientation is located (exclusively) outside the groove base.

In a preferred embodiment, the central tension band region extends at least in sections along the geometric center of the groove base and is preferably symmetrical with respect to the geometric center. In particular, the wall of the container is bulged inwardly at least in sections and preferably substantially along the geometric center of the groove base (in particular, when considering a main direction of the surface corresponding to a circumferential direction). This results in a particularly stable base geometry due to the symmetrical arrangement.

In a preferred embodiment, the groove base has at least a first and a second turning region, in which a surface region of the groove base changes the orientation of its bulge. Preferably, in the first turning region, the orientation of the first lateral tension band region (an outward bulge) changes to the orientation of the center tension band region (an inward bulge). Furthermore, in the second turning region (which is different from the first turning region), the orientation of the central tension band region (inward bulge) changes to the orientation of the second lateral tension band region (outward bulge).

Preferably, at least one (in particular, each) line running on the surface of the base region in the groove base, which extends along the circumferential direction (which in particular does not extend along the longitudinal direction), has a first turning region, in which a surface region of the groove base changes the orientation of its bulge and in particular is transferred from an outwardly-bulged region to an inwardly-bulged region. Furthermore, the line has a second turning region in which a surface region of the groove base changes the orientation of its bulge and, in particular, is transferred from an inwardly-bulged region to an outwardly-bulged region.

In a preferred embodiment, the tension band (which is implemented in particular by the groove base) is a free-formed base section. In particular, compared to the prior art container mentioned at the beginning, the original rotated surface is replaced by a free-form surface. A free-form cut makes it possible to distribute the material in a more targeted manner, even within the tension band. In this manner, (visible) distortions in particular, which can lead to weakening of the tension band, can also be avoided. This increases the stability of the base.

Free-form surfaces are understood as in particular three-dimensional, usually doubly-curved surfaces, which can preferably (in particular, only) be represented mathematically by splines (piecewise polynomial functions) and/or by means of NURBS (non-uniform rational B-spline).

In particular, the tension band or the groove base is designed as a free-form surface, which is connected to the surface edges of a foot flank surface or a transition region arranged to the side of a supporting foot, and to the base body of the container and to a central region around an injection point or at the injection point—in particular, in a tangentially-continuous manner and in particular in a curvature-continuous manner. The curvature progression of the free-form surface of the groove base in (any) predetermined direction can be described by polynomials of the nth degree.

Preferably, at least one, preferably at least two, and preferably at least three, characteristic parameters for the free-form surface of the groove base are selected and/or determined, e.g., approximated, in such a manner that the geometric shape of the free-form surface approximates a region of a spherical surface and, in particular, has a hemispherical (segmental) shape.

In an advantageous embodiment, a groove base cross-sectional contour in a cross-section perpendicular to the longitudinal direction of the container follows, at least in sections and preferably substantially completely, a spline of the nth degree, which deviates at least in sections from a circular line-shaped progression—in particular, in the central tension band region and/or the two lateral tension band regions. Advantageously, this allows the surface (of the central tension band region) to be bulged towards the bottle interior and to be variable in cross-section. This causes the tension band to fit better into the base geometry.

In a preferred embodiment, at least one groove base (preferably each groove base of each groove between two supporting feet) has a circumferential angle that is between 0.5° and 30°, preferably between 2.5° and 20°, preferably between 5° and 15°, preferably between 5° an d 10°, preferably between 6° and 9°, and particularly preferably 7.5°. This allows a sufficiently functional tension band to be achieved. Preferably, a groove base (one groove base in each case) between two supporting feet takes up substantially exactly one extension as viewed in the circumferential direction, which corresponds to an angular segment over the predetermined circumferential angle. Viewed in the circumferential direction, a groove base in particular thus extends along its entire extension along the longitudinal direction over the (substantially, exactly over the) predetermined circumferential angle.

With a further advantageous embodiment, the groove base (in particular in cross-section) is designed to be substantially symmetrical to the geometric center of the groove base. The symmetrical design results in a particularly uniform distribution of material and material stretching.

In a preferred embodiment, the central tension band region extends over a circumferential angle that is between 0.1° and 10°, preferably between 0.5° and 5°, and preferably between 1.5° and 3°. The provision of an inner bulge in a circumferential angular range selected in this manner enables the material to be distributed in a particularly targeted manner during the expansion process of the container.

In a preferred embodiment, a ratio, which the circumferential angle, over which the central tension band region extends, to the circumferential angle over which the two lateral tension band regions extend, (together) is in a range between 1:0.1 and 1:40, preferably between 9:1 and 1:19, preferably between 1:1 and 1:4, preferably between 1:2 and 1:3, and, particularly preferably, substantially 1:2.33.

Preferably, a ratio, which the circumferential angle, over which the central tension band region extends, to the circumferential angle over which the two lateral tension band regions extend, (together) is in a range between 90%:10% to 5%:95%, preferably in a range between 50%:50% to 20% to 80%, preferably in a range between 35%:65% and 25%:75%, and, particularly preferably, substantially 30%:70%.

Preferably, the (in particular, each) lateral tension band region is a flank of the tension band.

Preferably, a ratio of the circumferential angle, referred to as the "flank circumferential angle," over which (in particular, each of) the lateral tension band region extends (at least in sections and preferably substantially over the entire longitudinal extension), to the circumferential angle, referred to as the "center circumferential angle," over which the center tension band region extends (at least in sections and preferably substantially over the entire longitudinal extension) is in a range between 5%:90% and 47.5%:5%, preferably in a range between 25%:50% and 40%:20%, and particularly preferably (substantially) 35%:30%.

Preferably, a ratio between the flank circumferential angle of the one lateral tension band region, the center circumferential angle of the center tension band region, and the flank circumferential angle of the second lateral tension band region is in a range between 5%:90%:5% and 47.5%:5%:47.5%, preferably in a range between 25%:50%:25% and 40%:20%:40%, and particularly preferably (substantially) 35%:30%:35%.

This results in a particularly advantageous interaction of inwardly-bulged base regions (through the central tension band region), which distributes forces particularly advantageously towards the base body, and outwardly-bulged base regions (lateral tension band regions), which lead to a particularly good distribution of material during container production. With a tension band designed in this manner, both a high degree of base stability is achieved, while at the same time further reinforcement of the tension band is achieved through the significantly improved stretchability.

Preferably, the (maximum) circumferential angle over which the central tension band region extends is smaller than the (maximum) circumferential angle over which each of the lateral tension band regions extends. This advantageously reduces the contact surface with which the material first comes into contact in the stretching process, thus enabling a more optimal distribution of material.

With a further advantageous embodiment, a curvature of a groove base cross-sectional contour, which arises in a cross-section along the longitudinal direction of the container through the groove base—in particular, through the central tension band region and/or a lateral tension band region (preferably along the geometric center of the groove base)—is an offset of the contour towards the geometric center of the base body over the length of the central tension band region. Such offset is at its lowest level at the end of the central tension band region closest to the injection point/base center, viewed in the longitudinal direction, and increases correspondingly with increasing radial distance from the central axis and with increasing width (viewed in the circumferential direction) of the tension band region, such that the highest level of offset is found at the upper end of the central tension band region with the greatest radial distance from the central axis.

In the lower region, the offset is between 0.001% and 1% of the total diameter of the base, and preferably between 0.01% and 0.2%. In the upper region, the offset is between 0.01% and 3% of the total diameter of the base, and preferably between 0.03% and 0.05%.

Preferably, the tension band or the groove base has a so-called main tension band region (hereafter also referred to as central tension band region with respect to the longitudinal direction (in contrast to the term, "central tension band region," in which "central" in particular refers to a central arrangement in the circumferential direction—preferably between the two lateral tension band regions)).

Preferably, the main tension band region (viewed in the longitudinal direction)—in particular, in its entirety—is arranged between an upper tension band region and a lower tension band region.

In particular, the upper tension band region forms a connection to the container (base) body or to the side wall of the container. Preferably, the upper tension band region is outwardly bulged (viewed within a cross-sectional plane extending perpendicular to the longitudinal direction)—particularly preferably along the entire extension region—and/or follows the corresponding bulge of the adjacent container (base) body.

Preferably, the lower tension band region forms an inlet to the base center of the container and/or an injection point of the container. Preferably (viewed within a cross-sectional plane extending perpendicular to the longitudinal direction), the lower tension band region is rectilinear or has no curvature. Preferably, the lower tension band region is designed to be substantially planar or flat at least in sections, and preferably in its entirety.

Preferably, an upper transition region—preferably designed as a free-form surface—is arranged between the upper tension band region and the main tension band region. Thus, preferably, the main tension band region is not directly adjacent to the upper tension band region, but is adjacent to the upper transition region, which in turn is adjacent to the upper tension band region. In particular, the upper transition region has the function of transferring the curvature progression of the main tension band region into the curvature progression of the upper tension band region (in each case viewed in a cross-sectional plane extending perpendicular to the longitudinal direction). Preferably, therefore, the main tension band region is spaced apart from the upper tension band region when viewed in the longitudinal direction.

Preferably, a lower transition region—preferably designed as a free-form surface—is arranged between the lower tension band region and the main tension band region. Preferably, therefore, the main tension band region is not directly adjacent to the lower tension band region, but is adjacent to the lower transition region, which in turn is adjacent to the lower tension band region. In particular, the lower transition region has the function of transferring the curvature progression of the main tension band region into the curvature progression of the lower tension band region (in each case viewed in a cross-sectional plane extending perpendicular to the longitudinal direction). Preferably, therefore, the main tension band region is spaced apart from the lower tension band region when viewed in the longitudinal direction.

Preferably, the tension band within the main tension band region is bulged inwards in the central tension band region (with respect to the circumferential direction)—in particular, over its entire longitudinal progression.

Preferably, the main tension band region has the central tension band region (with respect to the circumferential direction) and the two lateral tension band regions, preferably over its entire longitudinal progression.

Preferably, the main tension band region—in particular, the central tension band region and/or the lateral tension band regions—preferably extends over at least 30%, preferably over at least 40%, preferably over at least 50%, preferably over at least 70%, preferably over at least 80%, and particularly preferably over at least 90%, of the longitudinal progression of the tension band (i.e., in particular, of the arc length of the tension band within a longitudinal cross-section through the tension band, and preferably through the geometric center of the central tension band region).

The main tension band region or the central tension band region with respect to the longitudinal direction preferably extends over a maximum of 95% and particularly preferably a maximum of 70% of the longitudinal progression of the tension band (i.e., in particular, the arc length of the tension band within the longitudinal cross-section through the tension band, and preferably through the geometric center of the central tension band region).

Preferably, the main tension band region or the average tension band region with respect to the longitudinal direction extends over between 50% and 70% of the longitudinal progression of the tension band.

In a further advantageous embodiment, a region, arranged between a supporting foot and a groove base, of the base section merges into the groove base in a tangentially-continuous and/or curvature-continuous manner. This also results in particularly good stretching of the material into the feet tips.

In an advantageous embodiment, a section, which can be described by a spline, of a groove base, and preferably of each groove base, merges in a tangentially-continuous and/or curvature-continuous manner into a section, adjoining the spline, of a supporting foot flank (a region of comparatively great steepness in a supporting region of a supporting foot).

In a further advantageous embodiment, the groove base of (each) groove (between two adjacent supporting feet) merges into the remaining region of the groove (and/or into a supporting region) and/or into a foot flank surface (of a supporting foot) in a region whose main direction of extension extends (substantially exclusively) in the radial direction on the base region wall and, in particular, not in the circumferential direction.

Preferably, the transition region from a groove base of (each) groove into the remaining region of the groove and/or into a foot flank surface (of a supporting foot) is given by a line formed on the base region, which extends along the base region (substantially exclusively) in the radial direction towards and not in a circumferential direction.

In a further advantageous embodiment, the curvature of a line formed along the base region, and preferably a base line, which extends from a supporting foot or a supporting region surrounding a supporting foot across at least one groove base, changes in the groove base by less than 30%, preferably by less than 25%, preferably by less than 20%, and particularly preferably by less than 15%.

Preferably, the container has several groove bases and/or grooves of the same shape. In particular, all grooves and/or groove bases between two supporting feet have the same shape.

In a further advantageous embodiment, a width (particularly, measured in the circumferential direction) of the groove base increases outwardly in a radial direction of the container and/or with increasing radial distance from the central axis.

With a further advantageous embodiment, a (preferably, each) region, arranged between a supporting foot and a groove base, of the base section merges into the groove base in a tangentially-continuous and/or curvature-continuous manner. In other words, one (in particular, each) region, arranged adjacent to the side of the groove base (viewed in the circumferential direction), of the base section (in particular, a foot flank surface) merges into the groove base in a tangentially-continuous and/or curvature-continuous manner. In such section, the tangent continuity or curvature continuity is viewed in particular with consideration of a transition in the circumferential direction and/or along a base line and/or at a radial viewing direction. Such a tangentially-continuous and/or curvature-continuous transition offers the advantage that plastic material to be distributed during a blow molding process can be moved or stretched, e.g., from the groove base (along the foot flank surfaces), into a supporting foot with as little friction as possible caused by the geometric shape (of the corresponding blow mold).

In a further advantageous embodiment, the groove base follows a circular sphere-like progression at least in sections (preferably at least the region of the groove base arranged between two supporting feet, viewed in the circumferential direction) and in particular substantially along its entire extension in the radial direction. Preferably, the base region between each two (adjacent) supporting feet has a region (extending substantially from a central region and/or injection point to the base body of the container) which has a circular spherical (segmental)-like progression. This offers the advantage that the advantageous geometric properties of a circular spherical (segmental) wall in terms of force transmission can be largely retained when the surface of the wall is (largely) approximated to a circular spherical (segmental) progression.

Preferably, the groove base deviates at least in sections and in particular in one (each) region between two supporting feet (viewed in the circumferential direction) from a (substantially) exactly hemispherical (segmental) wall section or progression. In other words, preferably no region of the groove base follows a strictly geometric hemispherical (segmental) progression.

By a hemispherical progression of a region, it is understood in particular that such region deviates no more than 20%, preferably no more than 10%, preferably no more than 5%, and particularly preferably no more than 2.5%, of a spherical radius from a sphere approximated to the region (in particular, in the radial direction with respect to the spherical center point of the approximated sphere).

Preferably, the groove base can be inscribed at least in sections—preferably a section of the groove base selected (in particular, in its entire extension in the circumferential direction)—between two supporting feet and particularly preferably in its entirety between two (hypothetical) circular spherical surfaces whose spherical radii deviate from one another by less than 20%, preferably less than 10%, preferably less than 5%, and particularly preferably less than 2.5%.

Preferably, a line formed along the geometric center between two adjacent supporting feet and/or the geometric center of the groove and/or the geometric center of the groove base on the wall deviates from an arc of a circle approximated thereto at least in sections (at any point of the formed line) by less than 20%, preferably less than 10%, preferably less than 5%, and particularly preferably less than 2.5%, of the radius of the approximated circular line with respect to a geometric distance of such formed line from the approximated circular line. Preferably, the line thereby formed takes up more than 20%, preferably more than 30%, preferably more than 40%, preferably more than 50%, preferably more than 60%, preferably more than 70%, preferably more than 80%, and particularly preferably more than 85%, of the arc length of a connecting line formed on the wall, running through the geometric center between two adjacent supporting feet and or through the geometric center of the groove and/or the groove base, between, on the one hand, the base center point and/or the injection point and, on the other, the transition of the base region into the base body. Preferably, such formed line can be described (at least in sections and preferably in a region of more than 85% of the arc length) by a spline of the nth degree. However, it is also conceivable that such formed line be able to be described by a circular line.

With a further advantageous embodiment, the groove base (or the tension band) is not a surface that is rotationally symmetrical about the central axis of the container (in particular, in its entirety, and preferably also not at least in sections). This distinguishes the design of the groove base from that of a groove base known in the prior art, in which the base contour tension band is rotated at both ends of an angular segment about a central axis through a tension band angle. A deviation from a rotationally-symmetrical surface section offers the advantage that this allows the curve progression to be adapted (in particular, with regard to the curvature), while at the same time maintaining a largely hemispherical segmental shape.

The mouth region preferably has an external thread and/or a support ring. Preferably, the base region has an injection point located in particular on the central axis, and the base region preferably has a central region surrounding such injection point—in particular, of rotationally-symmetrical design. Preferably, the injection point is located above the supporting feet of the container, viewed in the longitudinal direction (when the container is upright).

Preferably, the supporting feet or outer surfaces of these (in each case) form an in particular flat—in particular, extending (exclusively) in a plane perpendicular to the longitudinal direction, and preferably at least partially ring segment-shaped, extending over a predetermined circumferential angle—supporting section of the plastic container.

Preferably, the container has a filling volume (of a beverage) of at least 0.1 L, preferably at least 0.2 L, preferably at least 0.3 L, preferably at least 1 L, preferably at least 1.5 L, preferably at least 2 L, preferably at least 3.5 L, and in particular at least 5 L. Preferably, the container has a maximum filling volume of 5 L, preferably of 3.5 L, preferably of 2 L, preferably of 1.5 L, and preferably of 1 L. Preferably, the container has a filling volume in a range between 2 L and 3.5 L.

Preferably, the container is suitable for carbonated beverages.

Preferably, the base region has more than three, preferably more than four, preferably more than five, and particularly preferably more than seven, feet. Preferably, the base region has less than ten, preferably less than eight, preferably less than six, and particularly preferably less than four, feet. Preferably, the container has a petaloid base.

Preferably, the container base is axisymmetrical with respect to the central axis.

In a further advantageous embodiment, the container base has a substantially constant wall thickness at least in sections, and preferably over the entire surface. In particular, a wall thickness in the region of a supporting foot and the region of a groove base is substantially the same. This makes it possible to achieve the greatest possible stability of the container or container base, while using as little material as possible.

Preferably, a base contour of the base region of the container in a region of a supporting foot can be described by a base contour in such foot region, which preferably first has a rectilinear section (in particular, starting from a geometric center point of the container and/or an injection point and/or a central section), which is followed by a spline or curved section. Such curved section is preferably followed by a further curved section or spline, and preferably by a further curved section, with which the base region merges into the main body. The foot surface, and in particular the supporting foot and/or the supporting region, is generated from such base contour by rotating the base contour about the central axis of the container selected as the axis of rotation. Explicit reference is made to patent application DE 10 2013 110 139 A1 of the applicant, in which such a preferred geometry of the foot region of the base region (base section therein) is described (and illustrated in FIG. 2 and FIG. 3). All features described in this application with respect to the region of the supporting foot (and the curvature progression thereof) are also hereby to be deemed disclosed by reference.

Preferably, the region adjacent to the side of the groove base (viewed in the circumferential direction) is a foot flank surface of a supporting foot of the container. The foot flank surface is preferably designed as a free-form surface that is preferably connected to the surface edges of the supporting foot and/or a foot region and in particular to the surface edges of the base body (and in particular a central region and/or an injection point)—in particular, in a tangentially-continuous manner and preferably in a curvature-continuous manner. In particular, the free-form surface is a surface whose curvature progression in one (each) direction can be described by polynomials of the nth degree.

Preferably, the foot flank surface is designed as a free-form surface and, in particular, about a section of a free-form surface that is connected to the surface edges of an imaginary (or hypothetical; used for design), rotationally-symmetrically designed tension band surface (or groove base)—in particular, in a tangentially-continuous manner and in a curvature-continuous manner. This offers the advantage that the geometric shape of the foot region of the container base from the prior art can be retained.

The present invention is further directed to a blow molding device for producing plastic containers having an inner wall, against which a plastic container can be expanded during a blow molding process.

According to the invention, the inner wall has a contour that is suitable and intended for creating a plastic container, wherein the plastic container can be designed with all the features described above in connection with the plastic container, alone or in combination with one another.

In particular, the blow molding device has a base part that is suitable and intended for producing a base region of the type described above.

The present invention is further directed to a plastic container—in particular, for beverages—which has a base region, a base body adjoining such base region in the longitudinal direction of the plastic container, and a mouth region adjoining such base body at least indirectly in the longitudinal direction and having a container mouth.

The base region has at least three supporting feet—preferably at least five and particularly preferably exactly five supporting feet. At least one groove with a groove base extending in the circumferential direction over a (predetermined) circumferential angle is arranged between two—in particular, adjacent—such supporting feet. Thereby, the groove base acts as a tension band. In particular, the groove base is designed over the (predetermined) circumferential angle (in particular, by its shape) in such a manner that it acts as a tension band or is suitable for acting as a tension band. Furthermore, the container is preferably designed in one piece.

According to the invention, the (in particular, each) groove base (or a tension band) has—in particular, in each case—a central tension band region (and, in particular, two lateral tension band regions), in which the wall of the container is inwardly bulged and which is arranged in the circumferential direction between two lateral tension band regions.

According to the invention, the groove base—preferably in a cross-section perpendicular to the longitudinal direction (i.e., in particular, within a cross-sectional plane extending perpendicular to the longitudinal direction)—in the central tension band region preferably has, at least in sections (and preferably in the entire central tension band region), a curvature with a greater amount of curvature than the groove base in the two lateral tension band regions.

Thereby, the plastic container can be equipped with all of the features described above in connection with the plastic container, either individually or in combination with one another.

Thereby, the orientation of the curvature of the groove base in the lateral tension band region and preferably in the two lateral tension band regions can have the same orientation as the curvature or the bulge of the groove base in the central tension band region. Alternatively, the orientation of the curvature of the groove base in the lateral tension band region, and preferably in the two lateral tension band regions, can have an opposite orientation to the curvature or bulge of the groove base in the central tension band region. It is also conceivable that the groove base in the lateral tension band region and preferably in the lateral tension band regions be designed to be planar or flat and/or run in a rectilinear manner in cross-section or have no curvature.

The present invention is further directed towards a plastic container—in particular, for beverages—which has a base region, a base body adjoining such base region in the longitudinal direction of the plastic container, and a mouth region adjoining such base body at least indirectly in the longitudinal direction and having a container mouth.

The base region has at least three supporting feet—preferably at least five and particularly preferably exactly five supporting feet. At least one groove with a groove base extending in the circumferential direction over a (predetermined) circumferential angle is arranged between two—in particular, adjacent—such supporting feet. Thereby, the groove base acts as a tension band. In particular, the groove base is designed over the (predetermined) circumferential angle (in particular, by its shape) in such a manner that it acts as a tension band or is suitable for acting as a tension band. Furthermore, the container is preferably designed in one piece.

According to the invention, the (in particular, each) groove base (or a tension band) has—in particular, in each case—a central tension band region (and, in particular, two lateral tension band regions), in which the wall of the container is inwardly bulged and which is arranged in the circumferential direction between two lateral tension band regions.

According to the invention, the bulge of the groove base in the central tension band region is more pronounced, at least in sections, than a bulge of the groove base in the two lateral tension band regions (in particular, independently of the orientation of any bulge of the respective tension band region).

Thereby, the plastic container can be equipped with all of the features described above in connection with both plastic containers, either individually or in combination with one another.

Preferably, the orientation of the bulge of the groove base in the central tension band region can be the same or opposite to the orientation of the bulge of the groove base in the lateral tension band regions. It is also conceivable that the groove base not be bulged in the lateral tension band regions (at least in sections or in its entirety).

BRIEF DESCRIPTION OF THE DRAWINGS

Further advantages and embodiments result from the accompanying drawings. The following are shown therein.

DETAILED DESCRIPTION OF THE INVENTION

Figure 1:
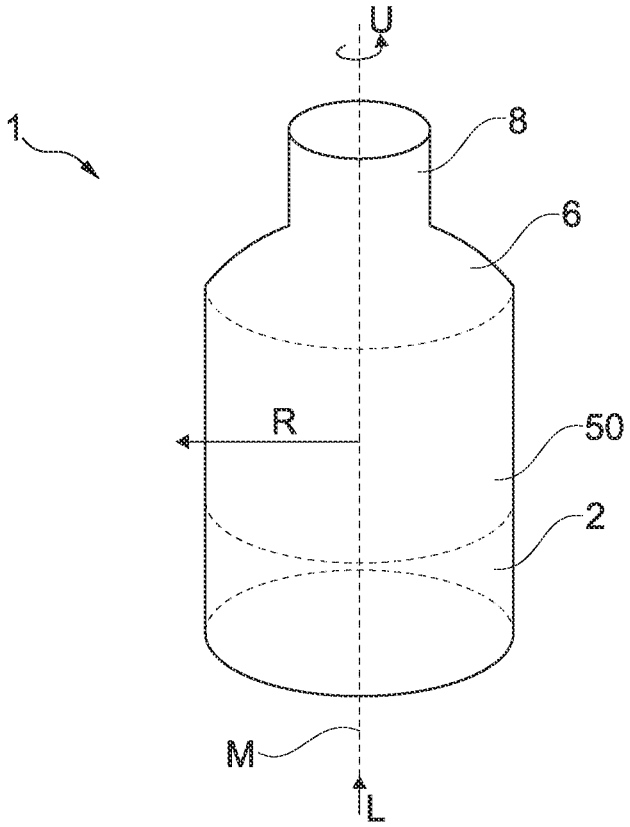
FIG. 1 is a schematic illustration of a plastic container.

FIG. 1 shows a schematic illustration of a plastic container 1. Here, such plastic container has a mouth region 6 with a container mouth 8 and a base body 50 adjoining the mouth region 6. Thereby, the base body 50 is used to hold the substantial filling volume. The shape of the base body can also be different from that shown in FIG. 1 and can, for example, have waves or patterns. Thereby, the mouth region 6 can have an external thread of the plastic container 1 and a support ring located at the container mouth 8. The container according to the invention also preferably has an external thread and a support ring.

The reference sign L designates a longitudinal direction of the plastic container 1. As illustrated, this is the longitudinal direction L and a direction along the central axis M of the container. A circumferential direction U, which is a direction of rotation about the central axis or longitudinal direction L as the axis of rotation, is also shown in FIG. 1.

A base region 2 of the plastic container 1 adjoins the base body 50, wherein the base body 50 can merge into the base region 2 via a curved section or via a non-curved section.

Figure 2:
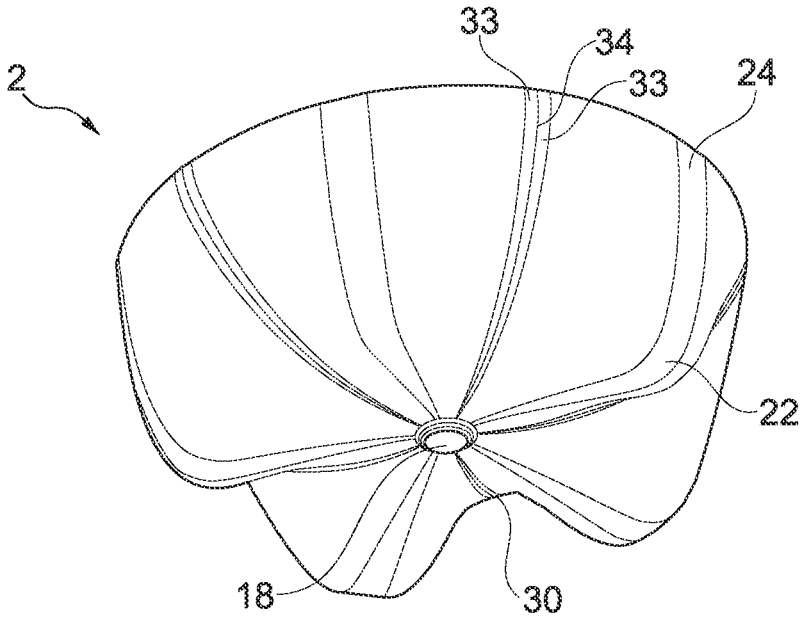
FIGS. 2-5 are various illustrations of a base region of a plastic container according to an embodiment of the prior art.

The reference sign 22 designates a supporting foot (not shown here) of the container (see, e.g., FIG. 2). The base region 2 can have several supporting feet 22 that allow it to stand upright on an even surface. The reference sign R refers to a radial direction relative to the central axis M or to the longitudinal direction L of the plastic container. Thereby, the radial direction R is perpendicular to the central axis M and the longitudinal direction L and either runs towards them or away from them towards the outside. In particular, the base body 50 is formed by or has a side wall. Such side wall extends fully in the circumferential direction U of the container.

Figure 3:
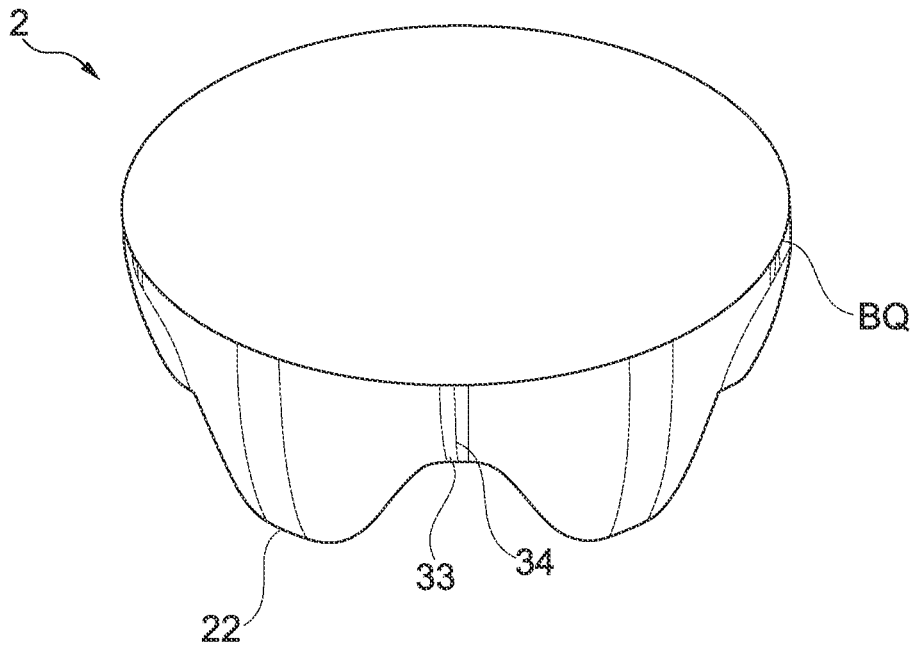
Figure 4:
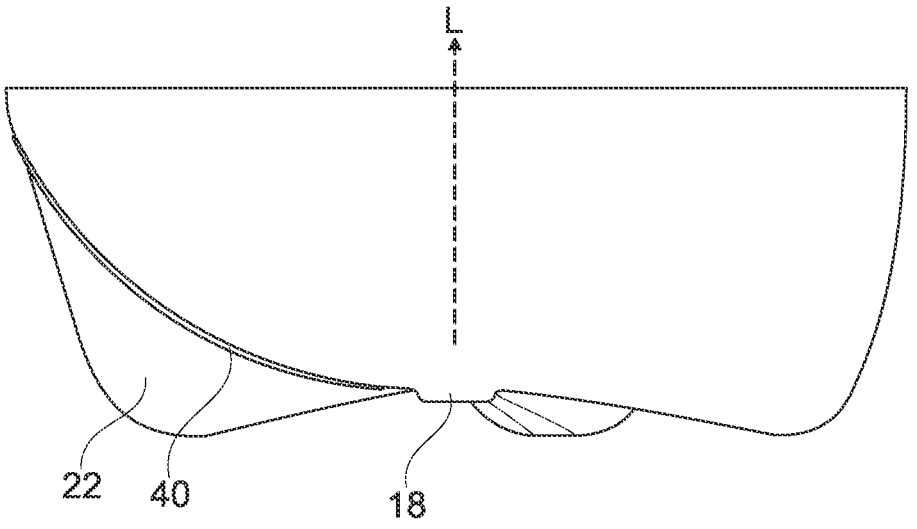
Figure 5:
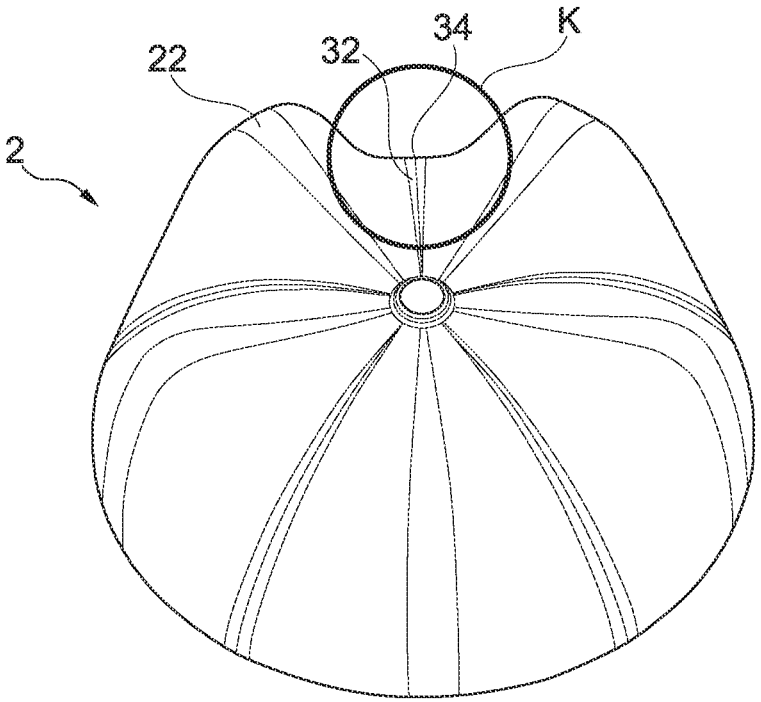

FIGS. 2-5 each show an illustration of a base region 2 of a (plastic) container in various perspectival views (FIGS. 2, 3, and 5) or in a sectional drawing (FIG. 4). This is a base section known from the prior art. Five supporting feet 22 on which the container can stand can be seen. The reference sign 24 designates in each case a region of the base region 2 that extends radially outwardly from the base center point from the central axis M and in each case encloses one (precisely one) supporting foot 22. Preferably, the supporting region 24 does not extend beyond the supporting foot 22, in each case as viewed in the circumferential direction U. Preferably, the supporting region 24 is a region of the base region 2 defined by a predetermined angular segment with respect to a rotation in the circumferential direction U about the central axis M as the axis of rotation.

Thereby, viewed in the radial direction, the supporting regions 24 converge in the direction of the central axis M and meet at a base center point or base center—here, the injection point 18 of the container. In an orientation of the container standing on a supporting plane, the injection point 18 preferably does not touch such supporting plane. Viewed in longitudinal direction L, the injection point 18 is thus located above the supporting feet 22, i.e., closer to the mouth region than the respective supporting feet 22.

A groove 30 is preferably formed between each two adjacent supporting feet. In particular, a groove is understood as a geometric structure that extends inwardly (i.e., closer to the direction of the central axis) with respect to the circumferential wall, i.e., for example, the wall of the base region (in particular, in comparison with the outer container wall in the region of the supporting feet, viewed in the circumferential direction).

The two reference signs 33 designate the groove base of a groove. Here, the groove base 33 is a region around the geometric center 34 of a groove. In particular, the groove base is a region that acts as a tension band and as such holds the base center in position, similarly to a "safety belt," even under internal pressure and the effect of temperature. For this purpose, the groove base, which acts as a tension band, transfers forces acting upon the base center point or the base center—such as an injection point of a plastic container—via the tension band to a side wall of the plastic container.

In the embodiment of a container according to the prior art shown in FIG. 2 and FIG. 3, the groove base 33 follows a substantially hemispherical progression. Thereby, a (each) single line, formed along the container (outer) surface on the base region 2 of the groove base 33 and running in the radial direction at the injection point 18 outwardly or towards the side wall or towards the base body, resembles or follows a circular line-shaped progression. Such a selection of the geometric curve progression of the groove base 33 has proved advantageous in particular with regard to a force transmission of a force acting upon the injection point against the longitudinal direction to a side wall of the base body 4.

Thereby, the reference sign BQ designates a boundary line (preferably, substantially circular line-shaped in cross-section (with respect to a plane running perpendicular to the longitudinal direction or the central axis)) of the base region 2, at which the base region 2 adjoins the main body.

FIG. 4 shows an illustration of the container 1 from the two previous FIGS. 2 and 3, which is bisected along a sectional plane, which runs along the central axis M of the container or the longitudinal direction L and here along the geometric center 34 of a groove base 33, through the injection point 18 as well as a supporting foot 22.

The reference sign 40 designates a groove base cross-sectional contour, which here runs along the geometric center 34 of the groove base 33.

Figure 6:
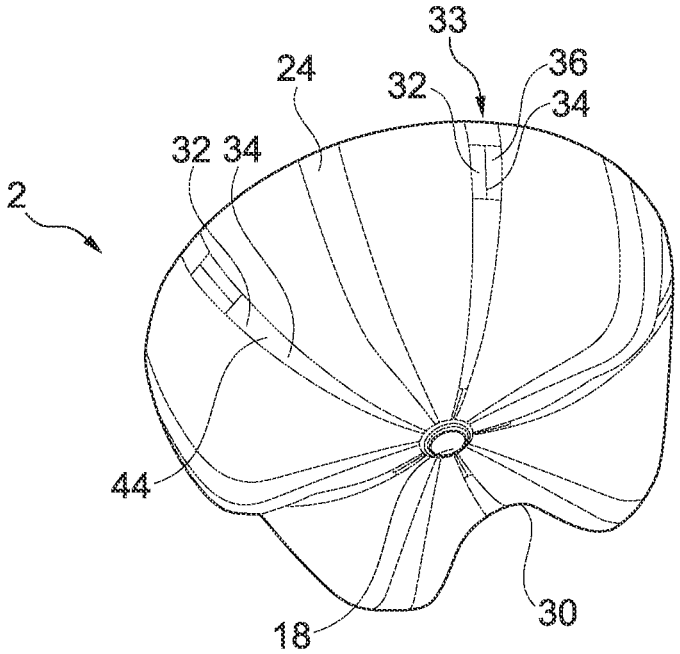
FIGS. 6-9 are various illustrations of a base region of a plastic container according to one embodiment of the present invention.
Figure 7:
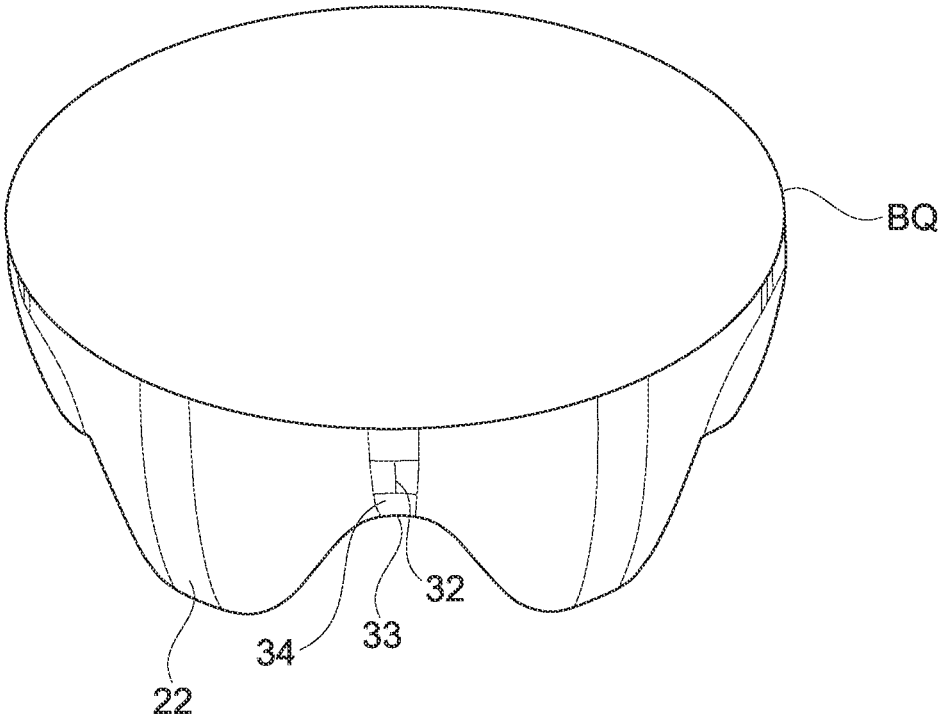
Figure 8:
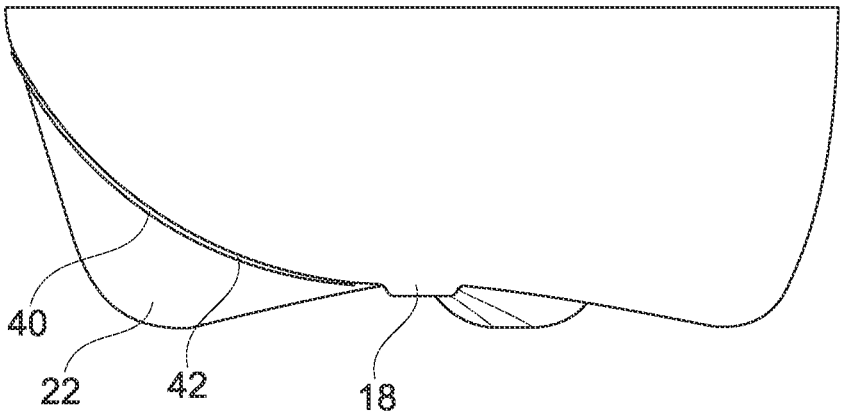

FIGS. 6-9 show various illustrations of a base region 2 of a plastic container 1 according to one embodiment of the present invention. Thereby, FIGS. 6, 7, and 9 each show an illustration of the base region 2 of the (plastic) container in various perspectival views, and FIG. 8 shows the base region in a sectional drawing.

As in FIGS. 2-5, this is also a petaloid base. In addition, the base region 2 shown here also has five supporting feet 22 with supporting regions 24 assigned to each of them. The supporting feet are preferably designed in the exact same manner as those in the prior art, which is illustrated approximately in FIGS. 2-5.

Like the base region from the prior art, the base region 2 shown here also provides a groove base 33 acting as a tension band. A groove base 33 is arranged (exactly) between each two supporting regions 24. Thereby, both the various supporting regions and the groove bases 33 are (substantially) of the same design. Thereby, the reference sign 34 designates the geometric center of a (respective) groove base 30, and the two reference signs 32 and 34 each designate a lateral tension band region of the groove base 33, which preferably extend substantially over two—preferably differing from one another—angular segments with respect to the circumferential angle (with respect to the central axis of the plastic container)—preferably substantially over virtually the entire extension of the base region 2 as viewed in the longitudinal direction L.

Preferably, the two lateral tension band regions 32 and 34 of a groove base 33 are arranged on an opposite side with respect to the geometric center 34 of the tension band or groove base 33.

In the embodiment illustrated in FIGS. 6-9, the base region 2 has a central tension band region 44, in which the surface is bulged towards the bottle interior. The bulge towards the bottle interior causes the tension band to fit better into the (base) geometry, making it advantageously easier to stretch the material into the feet.

Starting from the base region 2 from the prior art (illustrated by FIGS. 2-5), the base region 2 illustrated in FIGS. 6-9 of a container according to the present invention is constructed according to a preferred embodiment in such a manner that the originally rotated surface between the (supporting) feet, which in particular forms the tension band, is replaced by a free-form surface. The free-form cut makes it possible to distribute the material in a more targeted manner within the tension band as well.

FIG. 8 shows an illustration of the container 1 from the two previous FIGS. 6 and 7, which is bisected along a sectional plane, which runs along the central axis M of the container or the longitudinal direction L and here along the geometric center 34 of a groove base 33, through the injection point 18 as well as a supporting foot 22.

FIG. 8 illustrates that the surface of the groove base or the tension band (is not only bulged towards the bottle interior, but also that the surface) is variable in cross-section, such that the material can be distributed and conditioned in a better and more targeted manner. The reference sign 40 designates a cross-sectional contour of a groove base or a tension band according to the prior art (illustrated approximately by FIGS. 2-5; compare in particular FIG. 4), while the reference sign 42 illustrates an embodiment of a cross-sectional contour of the groove base 33 or the tension band according to an embodiment of the present invention. Thereby, it is apparent from a comparison of the two cross-sectional contours 42 and 40 that the cross-sectional contour 42 according to an embodiment of the present invention is arranged closer to the central axis M, and here in particular in a central height region of the container base 2 with respect to the longitudinal direction L.

The embodiment illustrated in FIGS. 6-9 offers the advantage of avoiding the formation of distortions. Furthermore, stability is increased. In addition, the ability to be blown/formed is advantageously improved.

Figure 9:
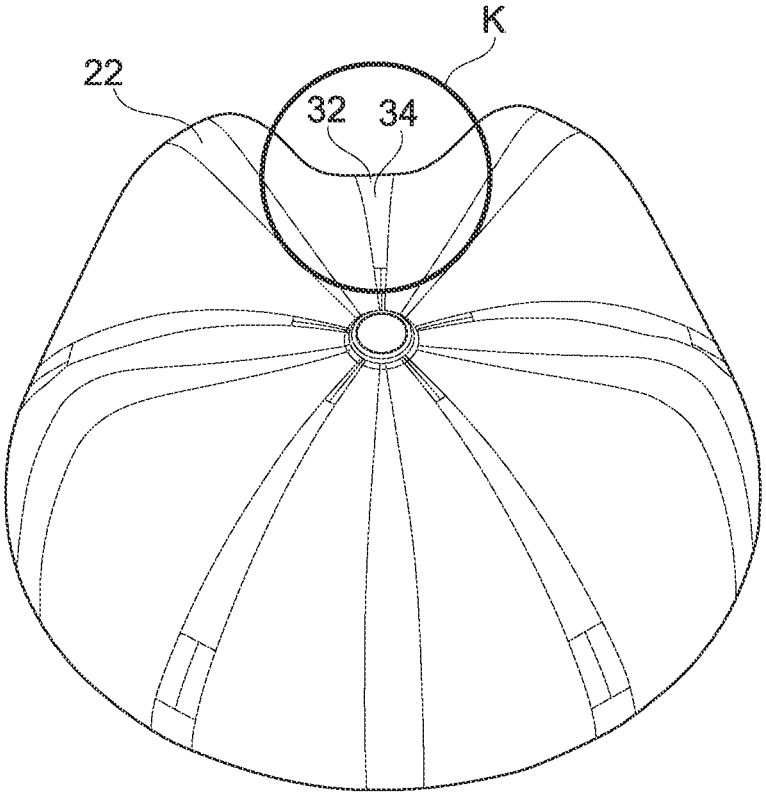
Figure 10:
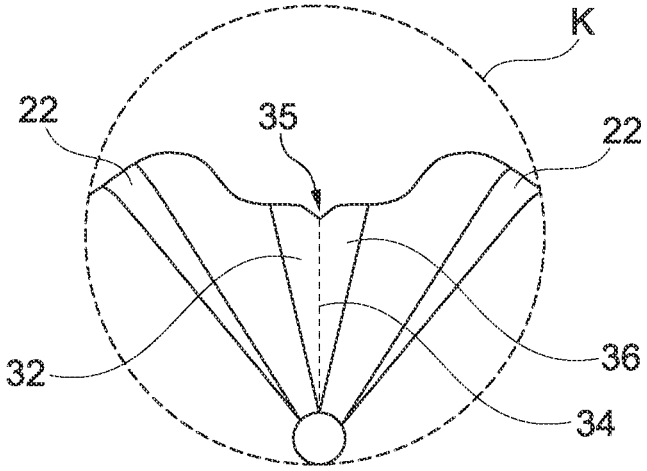
FIG. 10 is a schematic illustration of an enlarged circular section of the base region shown in FIG. 9.

FIG. 10 shows a schematic illustration of an enlarged circular section K of the base region 2 shown in FIG. 9, in which two adjacent feet 22 can be seen along with a groove base, lying between them, which here has the two lateral tension band regions 32 and 34 along with a central tension band region, to which the arrow 35 designated by the reference sign points.

In this enlarged illustration, it is illustrated at the upper edge region that the center tension band region is bulged inwards (towards the container interior). This central tension band region extends along the geometric center 34 of the groove base 33 (substantially along the entire length of the base wall region formed by the geometric center 34 of the groove base). In contrast, the two lateral tension band regions 32 and 34 are either inwardly curved, outwardly curved (as in FIG. 9), each preferably similar to a spherical segment, or rectilinear.

Figure 11:
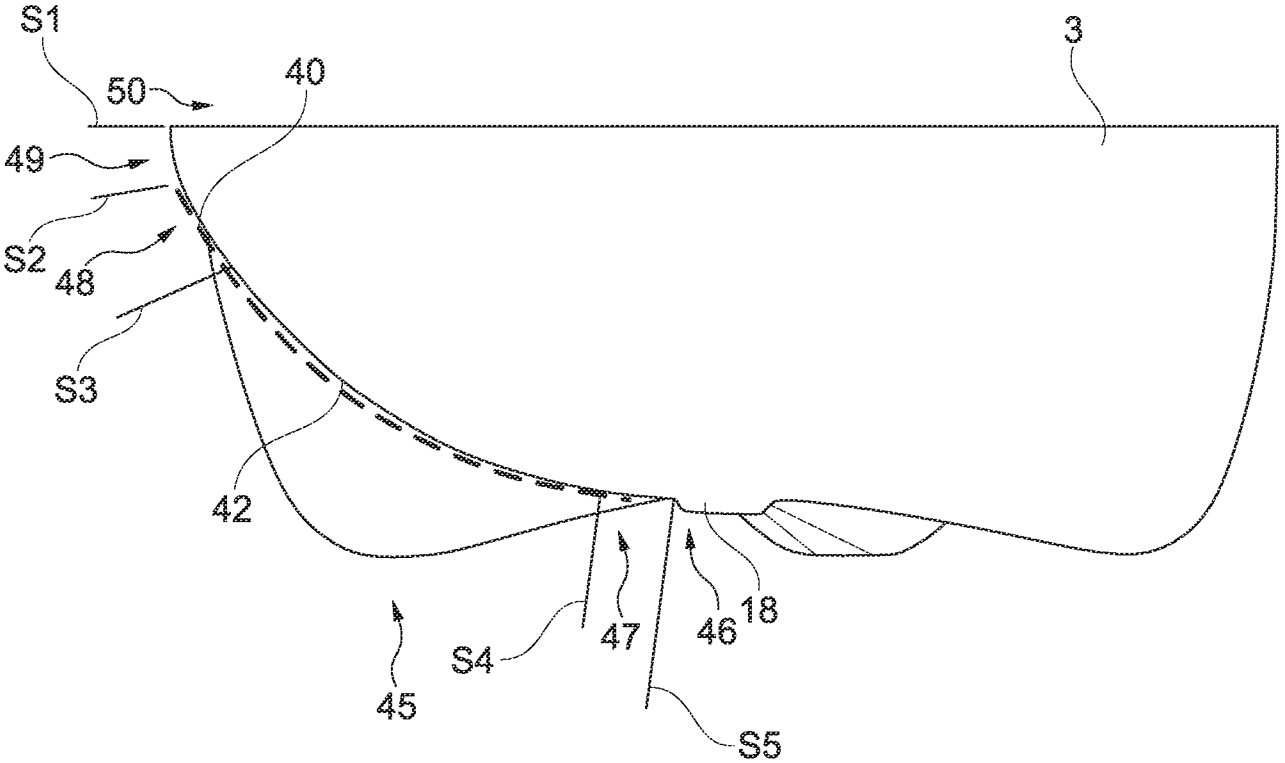
FIG. 11 is a tension band longitudinal section.

FIG. 11 shows a tension band longitudinal section, i.e., a cross-section through the container or container base 2 by the tension band or groove base (here, in a central tension band region), wherein the cross-section extends along the longitudinal direction L and in particular along the central axis M of the container.

The reference sign 3 designates the base interior space. Above (in the plane of the figure) the base region illustrated in FIG. 11, the bottle (base) body 50 (not illustrated here, but the location, designated by the reference sign 50, of the region of the bottle body) is adjacent.

It is made clear that the longitudinal progression of the tension band can preferably (in particular, in the central tension band region) be divided into different sections (viewed in the longitudinal direction). A so-called "upper tension band region" 49, which is preferably outwardly bulged, is located in the (longitudinal) section between S1 and S2. This is preferably followed by an upper transition section 48 in the (longitudinal) section between S2 and S3. This is followed in particular (in the figure, in the (longitudinal) section between S3 and S4) by a main tension band region 45 (central with respect to the longitudinal direction). This is followed by a lower transition region 47 in the (longitudinal) section between S4 and S5 and preferably by a lower tension band region 46, which is preferably designed as an inlet to the base center or to the injection point 18.

The main tension band region 45 or the central tension band region with respect to the longitudinal direction L preferably extends over at least 30%, preferably over at least 40%, preferably over at least 50%, and particularly preferably over at least 70%, of the longitudinal progression of the tension band (i.e., in particular, of the arc length of the tension band within the longitudinal cross-section through the tension band, and preferably through the geometric center of the central tension band region).

The main tension band region 45 or the central tension band region with respect to the longitudinal direction L preferably extends over a maximum of 95%, and preferably a maximum of 70%, of the longitudinal progression of the tension band (i.e., in particular, of the arc length of the tension band within the longitudinal cross-section through the tension band, and preferably through the geometric center of the central tension band region).

Preferably, the main tension band region or the central tension band region with respect to the longitudinal direction L extends over between 50% and 70% of the longitudinal progression of the tension band.

Preferably, the tension band within the main tension band region 45 is inwardly bulged in the central tension band region (with respect to the circumferential direction).

The reference sign 40 designates a tension band longitudinal section according to a container base in one embodiment according to the prior art.

The reference sign 42 designates the tension band longitudinal section according to a preferred embodiment of the present invention.

Figure 12B:
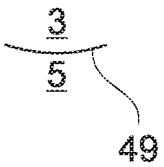
FIGS. 12*a*-12*d* are exemplary illustrations of the container base for describing the tension band cross-section.
Figure 12C:
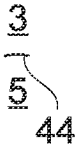
Figure 12D:
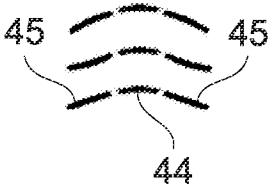
Figure 12A:
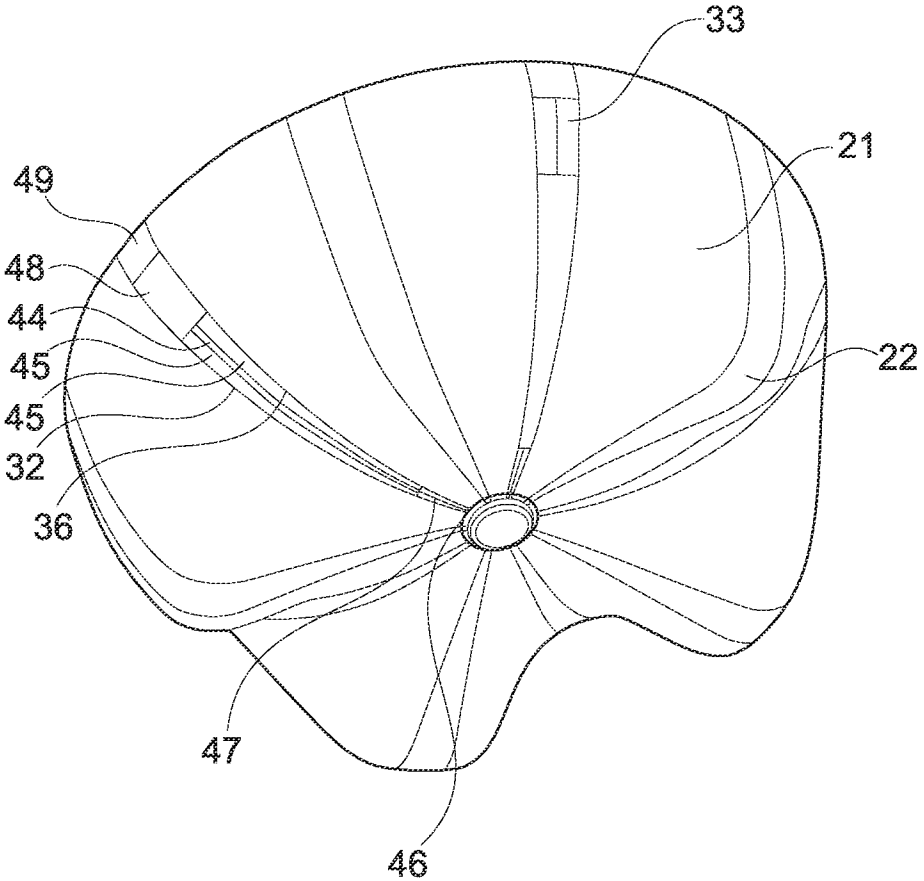

FIG. 12*a* shows an exemplary illustration of the container base for describing the tension band cross-section—in particular, in addition to the various tension band regions shown in FIG. 11.

The reference sign 22 designates a supporting foot, and the reference sign 21 designates a foot flank surface, which is preferably designed as a free-form transition. The reference sign 33 also designates the groove base (colored in darker gray), which here forms the tension band.

In particular, the upper tension band region 49 directly adjoins the container base body 50. Preferably, the upper tension band region 49 (in particular, in the entire region)—in particular, in a cross-section perpendicular to the longitudinal axis and/or central axis (i.e., in particular, within a cross-sectional plane extending perpendicular to the longitudinal direction)—is outwardly bulged. Preferably, the upper tension band region 49 forms the connection to the bottle body.

FIG. 12*b* illustrates the outward bulge of the upper tension band region 49 in a cross-section perpendicular to the longitudinal axis L. Thereby, the region (in the figure plane of FIG. 12*b*) above the upper tension band region 49 shown in cross-sectional view (cross-section perpendicular to the longitudinal axis) is the base interior space designated by the reference sign 3, while the region below the upper tension band region 49 shown in cross-sectional view is the container exterior space. The reference sign 5 designates the exterior space.

As in FIG. 11, the reference sign 48 designates the upper transition region of the tension band or groove base 33. Preferably, the upper transition region 48 of the tension band or of the groove base 33 is designed as a compensation area between the regions (here, between the upper tension band region 49 and the central tension band region 45 or main tension band region as viewed in the longitudinal direction—in particular, as a free-form surface.

The reference signs 44 and 45 designate a central or main tension band region, as viewed in the longitudinal direction L of the tension band, which is preferably arranged between the upper transition region 48 and a lower transition region 47. Preferably, the lower transition region 47 is provided as a transition between the (adjacent) regions—here, in particular, between the main tension band region 44, 45 and a lower tension band region 46. The lower tension band region 46 preferably illustrates an inlet to the base center and/or injection point 18. Preferably, the lower tension band region 46 has no bulge in one (preferably each) cross-section (in particular, perpendicular to the longitudinal direction L). Preferably, the lower tension band region 46 is substantially planar or flat.

Preferably, the lower transition region 47 is designed as a free-form transition.

The reference sign 44 designates a central tension band region (viewed in circumferential direction U) (here, of the main tension band region or the central tension band region viewed in the longitudinal direction). Such central tension band region 44 (viewed in circumferential direction U) is arranged, viewed in circumferential direction U, between two lateral tension band regions, which are also referred to as "flanks" of the tension band and are designated by reference signs 32 and 36.

FIG. 12*c* illustrates the fact that the central tension band region 44 ("central tension band region—"center") (viewed in circumferential direction U) is always inwardly bulged in cross-section (perpendicular to the longitudinal axis)—in particular, in the central tension band region or in the main tension band region 45 viewed in longitudinal direction L. As in FIG. 12*b*, in FIG. 12*c*, also, the region (in the figure plane of FIG. 12*c*) above the upper tension band region 44 shown in cross-sectional view (cross-section perpendicular to the longitudinal axis) is the base interior space (designated by reference sign 3), while the region below the upper tension band region 49 shown in cross-sectional view is the container exterior space. The reference sign 5 designates the exterior space.

In FIG. 12*a*, the two reference signs 45 each designate a so-called "flank" of the tension band or of the groove base 33 in the central tension band region (viewed in the longitudinal direction). The two reference signs 45 designate in particular the two lateral tension band regions 32 and 36 of the main tension band region 45 and the central tension band region viewed in longitudinal direction L.

Each of such "flanks" 45 of the central tension band region or main tension band region 45 (viewed in the longitudinal direction) is preferably inwardly bulged, but can also be outwardly bulged or linear. FIG. 12*d* illustrates this by illustrating three different tension band cross-sections (wherein the cross-sectional plane is perpendicular to the longitudinal direction L) through the central tension band region viewed in the longitudinal direction L or through the main tension band region 45. The central section of each of the three illustrated tension band cross-sections shows the central tension band region 44 (viewed in the circumferential direction U), and the two outer sections each show a "flank" 45 or the lateral tension band regions 32, 36 of the main tension band region 45.

The upper illustration of FIG. 12*d* shows a preferred embodiment in which the lateral tension band regions 32, 36 of the main tension band region are inwardly bulged in cross-section (i.e., here, within a cross-sectional plane perpendicular to the longitudinal axis L). In this embodiment, both the central tension band region 44 (viewed in the circumferential direction U) and the two lateral "flank" tension band regions 45 are inwardly bulged.

As in FIGS. 12*b,c*, in FIG. 12*d*, also, the region (in the figure plane of FIG. 12*d*) above the respective tension band region 44, 45 shown in cross-sectional view (cross-section perpendicular to the longitudinal axis) is in each case the base interior space, while the region below the tension band region 44, 45 shown in cross-sectional view is the container exterior space.

The middle illustration of FIG. 12*d* shows an alternative preferred embodiment in which the lateral tension band regions 32, 36 of the main tension band region 45 are outwardly bulged in cross-section (i.e., here, within a cross-sectional plane perpendicular to the longitudinal axis L). In this embodiment, the bulge of the container wall region of the central tension band region 44 (viewed in the circumferential direction U) with the inward bulge is oriented in the opposite direction compared to the bulge of the two lateral "flank" tension band regions 45 (both outwardly bulged).

The lower illustration of FIG. 12*d* shows a further alternative preferred embodiment in which the lateral tension band regions 32, 36 of the main tension band region 45 have no bulge in cross-section (i.e., here, within a cross-sectional plane perpendicular to the longitudinal axis L), but are designed to be linear. Therefore, in this embodiment, in contrast to the (inward) bulge of the container wall region of the central tension band region 44 (viewed in the circumferential direction U), the respective lateral "flank" tension band region is not bulged (but runs linearly or rectilinearly).

The applicant reserves the right to claim all features disclosed in the application documents as essential to the invention, provided that they are novel in relation to the prior art individually or in combination. It is also pointed out that features which can be advantageous in themselves are also described in the individual figures. The person skilled in the art will immediately recognize that a particular feature described in a figure can be advantageous even without the adoption of further features from this figure. Furthermore, the person skilled in the art will recognize that advantages can also result from a combination of several features shown in individual or in different figures.

LIST OF REFERENCE SIGNS

1 Plastic container
2 Base region
3 Base interior space
4 Base body
5 Exterior space
6 Mouth region
8 Container mouth
18 Injection point
19 Geometric center of the base wall (or base region)
21 Foot flank surface
22 Supporting foot
24 Supporting region/supporting section
30 Groove
32 Lateral tension band region
33 Groove base
35 Arrow pointing to central tension band region
36 Lateral tension band region
40 Groove base cross-section contour
42 Groove base cross-section contour
44 Central tension band region

45 Main tension band region
46 Lower tension band region
47 Lower transition region
48 Upper transition region
49 Upper tension band region
50 Base body
BQ Boundary line of the base region
L Longitudinal direction
M Central axis
K Circle
S1-S5 Section boundaries

The invention claimed is:

1. A plastic container comprising a base region, a base body adjoining such base region in the longitudinal direction of the plastic container, and a mouth region adjoining such base body at least indirectly in the longitudinal direction and having a container mouth, wherein the base region has at least three supporting feet, wherein at least one groove with a groove base extending in the circumferential direction over a circumferential angle is arranged between two supporting feet, wherein the groove base acts as a tension band, wherein the container is designed in one piece, wherein the groove base has a central tension band region in which a wall of the container is inwardly bulged and which is arranged in the circumferential direction between two lateral tension band regions, wherein the groove base is designed in a cross-section perpendicular to the longitudinal direction in the central tension band region according to a first curvature property and is designed in the two lateral tension band regions according to a second curvature property, which is different from the first curvature property, wherein a tension band serves to transfer forces acting upon a base center point or a base center to a side wall of the plastic container via the tension band, wherein the groove and the groove base extend over at least 80% of an arc length of a line starting from an injection point and/or a central region formed from there on a base wall in a radial direction outwardly to the base body, wherein a ratio of an amount of curvature of the groove base in the central tension band region to an amount of curvature of the groove base in the lateral tension band region is greater than 2.

2. The plastic container according to claim 1,
wherein
the central tension band region extends at least in sections along the geometric center of the groove base.

3. The plastic container according to claim 1,
wherein
the groove base in a cross-section perpendicular to the longitudinal direction in the central tension band region has, at least in sections, a curvature with a greater amount of curvature than the groove base in the two lateral tension band regions.

4. The plastic container according to claim 1,
wherein
the groove base has at least a first and a second turning region, in which a surface region of the groove base changes the orientation of its bulge.

5. The plastic container according to claim 1,
wherein
the tension band is a free-formed base section.

6. The plastic container according to claim 1, wherein at least one groove base has a circumferential angle of between 0.5° and 30°.

7. The plastic container according to claim 1,
wherein
the central tension band region extends over a circumferential angle that is between 0.1° and 10°.

8. The plastic container according to claim 7,
wherein
a ratio, which the circumferential angle, over which the central tension band region extends, to the circumferential angle over which the two lateral tension band regions extend, is in a range between 1:0.1 and 1:40.

9. The plastic container according to claim 1,
wherein
the groove base is designed to be substantially symmetrical to the geometric center of the groove base.

10. The plastic container according to claim 1,
wherein
a region, arranged between a supporting foot and a groove base, of the base region merges into the groove base in a tangentially-continuous and/or curvature-continuous manner.

11. The plastic container according to claim 1,
wherein
a groove base cross-sectional contour at a cross-section perpendicular to the longitudinal direction of the container follows a spline of the nth degree at least in sections.

12. The plastic container according to claim 11,
wherein
a section, which can be described by a spline, of a groove base merges in a tangentially-continuous and/or curvature-continuous manner into a section, adjoining the spline, of a supporting foot flank.

13. A blow molding device for the production of plastic containers having an inner wall, against which a plastic container can be expanded during a blow molding process,
wherein
the inner wall has a contour that is configured for creating a plastic container according to claim 1.

14. The plastic container according to claim 1, wherein
the groove base and/or the central tension band region and/or the two lateral tension band regions extend/extends radially outwardly from the injection point or a central region surrounding it, substantially up to the base body.

15. The plastic container according to claim 1, wherein the wall of the container or the groove base is outwardly bulged in each of the two lateral tension band regions at least in some regions.

16. The plastic container according to claim 1, wherein the wall of the container or the groove base is bulged inwards in each of the two lateral tension band regions at least in some regions.

17. The plastic container according to claim 1, wherein the groove and the groove base region extend over at least 90% of the arc length of a line starting from the injection point and/or the central region and formed from there on the base wall in the radial direction outwardly to the base body.

* * * * *